US005440800A

United States Patent [19]

Terada et al.

[11] Patent Number: 5,440,800

[45] Date of Patent: Aug. 15, 1995

[54] METHOD OF PRE-APPLYING SOLDERING MATERIAL TO A MOTOR COMMUTATOR

[75] Inventors: Yuichi Terada, Hamamatsu; Satoru Hamano, Kariya; Kazunobu Kanno, Toyohashi, all of Japan

[73] Assignee: ASMO Co. Ltd., Japan

[21] Appl. No.: 9,418

[22] Filed: Jan. 27, 1993

Related U.S. Application Data

[63] Continuation of Ser. No. 718,658, Jun. 21, 1991, abandoned.

[30] Foreign Application Priority Data

Jun. 26, 1990 [JP] Japan ..... 2-168060
Jun. 26, 1990 [JP] Japan ..... 2-168061

[51] Int. Cl.[6] ..... H01R 43/00

[52] U.S. Cl. ..... 29/597; 228/254; 228/258; 310/234

[58] Field of Search ..... 29/597, 598; 310/42, 310/45, 234; 228/254, 258

[56] References Cited

U.S. PATENT DOCUMENTS 2,400,590 5/1946 Meyerhoefer ..... 29/597
2,653,258 9/1953 Allen ..... 310/234
4,862,575 9/1989 Shirai et al. ..... 29/424

FOREIGN PATENT DOCUMENTS 2328698 12/1974 Germany .
49-78107 7/1974 Japan .
61-191245 8/1986 Japan .
63-265548 2/1988 Japan .
63-265549 2/1988 Japan .

*Primary Examiner*—Carl E. Hall
*Attorney, Agent, or Firm*—Venable, Baetjer, Howard & Civiletti

[57] ABSTRACT

A method of adhering in advance a soldering material to a location on each of a plurality of claw-shaped portions of a commutator at which a winding for the armature of an electric motor is to be electrically connected thereto, for ensuring a strong and reliable electrical connection between the windings and the claw-shaped portions.

A plurality of narrow grooves are defined in the claw-shaped portions and the narrow grooves are charged with molten soldering material, which solidifies therein. The thus-solidified soldering material is thereafter remelted by heat produced at the time of resistance welding of the windings to the claw-shaped portions to thereby reinforce the electrical connection between the claw-shaped portions and the windings and to prevent an increase in the electric resistance between the windings and the claw-shaped portions.

13 Claims, 10 Drawing Sheets

20
22
24
26
28
30
32
14
12
12B

METHOD OF PRE-APPLYING SOLDERING MATERIAL TO A MOTOR COMMUTATOR

This application is a continuation of application Ser. No. 718,658, filed Jun. 21, 1991 (now abandoned.)

BACKGROUND OF THE INVENTION

1. Field of the Invention

The present invention relates to a method of adhering soldering material, and more particularly to a method of applying a soldering material to a connecting member to which a connecting line is to be coupled by thermal welding.

2. Description of the Related Art

Commutators for electric motors are known, such as, for example, connecting members, to which connecting lines are respectively coupled by thermal welding.

The commutator has "claw"-shaped connecting portions (segments thereof) to which windings for an armature coil are electrically connected by, for example, resistance welding. The commutator, however, has a problem in that the electrical resistance between the claw-shaped connecting portions and the coil windings is increased due to the expansion and contraction of respective parts produced at the time of occurrence of a substantial difference in temperature between the parts to which the windings are connected (attached by applying pressure only) to the claw-shaped connecting portions. Since a slight interval is defined between each of the claw-shaped connecting portions and the respective windings, the commutator is prone to oxidation. In this case, too, there is a similar problem to that mentioned above in that the electrical resistance is increased.

Therefore, a method is known wherein soldering material is applied in advance to claw-shaped connecting portions of the commutator referred to above and thereafter re-melted by heat produced at the time the windings are electrically connected (attached by pressure) to the claw-shaped connecting portions, so as to cause the periphery of each of portions where the windings are electrically connected to the claw-shaped connecting portions to be covered with the molten soldering material, thereby preventing any increase in electrical resistance due to either thermal expansion and contraction or to oxidation.

As methods of adhering soldering materials to connecting members such as commutators, etc. to which connecting lines are to be electrically connected by thermal welding, there are known various methods such as a barrel-type electrolytic plating method, a melt plating method or a method of forming a laminated plate to which a soldering material is applied in advance in the form of a cylinder. The method of adhering a soldering material to the claw-shaped connecting portions of a commutator by barrel-type electrolytic plating, for example, is normally used, because large production capacity can be ensured.

For the above-described barrel-type electrolytic plating method, however, large equipment needs to be provided, (for example, an electrolytic plating apparatus), and it is absolutely necessary to provide acidic waste-liquid processing facilities. It is also necessary to perform pre-processing such as cleaning using acid solution, to enable reliable application of the plating process to commutators or the like.

According to the melt plating method, the plating process can be carried out by small equipment or simple effluent treatment facilities. However, this method has the problem that the adhered soldering material is thick and the amount of soldering material to be used must be large due to the oxidation of the soldering material.

Thus, conventional soldering material adhering methods have problems in that the soldering material is adhered to portions other than those portions to which the member to be connected is electrically connected to the connecting lines, i.e., portions to which it is unnecessary to apply the soldering material. Therefore, the amount of the soldering material which adheres to the portions referred to above other than those at which the lines are to be connected is increased and the manufacturing cost of a commutator is high. For this reason, it has been proposed that masking be applied to the portions to which it is unnecessary to apply soldering material, so as to prevent the soldering material from adhering to such portions. However, this approach takes time, and the production efficiency of the commutator is greatly reduced and hence its manufacturing cost becomes high.

SUMMARY OF THE INVENTION

With the foregoing problems in view, it is a principal object of the present invention to provide a method of adhering a soldering material to a connecting member, which is capable of reducing the amount of adhesion of the soldering material to the member to the minimum amount required, providing the lowest possible manufacturing cost, and realizing this with small and simple facilities; so as to provide a commutator of such a type that the respective connecting lines and claw-shaped connecting portions are firmly connected to each other.

According to one aspect of the present invention, there is provided a method of adhering a soldering material to a connecting member, i.e., a base material to which connecting lines or wire are to be connected by thermal welding, the method comprising the steps of at least defining in the connecting member concave portions each of which communicates with one of a number of portions where the connecting lines are to be connected to the base material, and then introducing molten soldering material into the concave portions so as to charge only the concave portions with the molten material.

A commutator according to the present invention for an electric motor has a plurality of claw-shaped connecting portions in each of which at least one narrow groove is defined, and this groove is charged with a soldering material.

According to the present invention, as described above, the concave portions, which communicate with the portions at which the connecting lines are to be electrically connected to the base material, are defined in the connecting member, i.e., the claw-shaped connecting portions. When the molten soldering material is introduced into the respective concave portions, it is successively charged only into the concave portions so as to reach the portions at which the connecting lines are connected to the base material.

When the connecting lines are electrically connected to the base material by thermal welding, the soldering material is melted again by the heat produced at that time by the process of electrical connection, so that the whole periphery of each of the connections is covered with the soldering material. It is therefore possible to prevent the subsequent oxidation of the connections, and a resulting increase in electrical resistance.

As described above, the soldering material is not applied to any portions other than the portions at which the connecting member is to be electrically connected to the connecting lines, i.e., it is not applied to any of the portions to which it is normally unnecessary to apply the soldering material. It is therefore unnecessary to apply any masking to such portions, and the amount of the soldering material adhering to such portions can be reduced to the minimum amount required, thereby making it possible to reduce the manufacturing cost of the commutator. Since only molten soldering material is used, acidic waste-liquid processing facilities are unnecessary and the soldering material adhering process can be performed by small and simplified equipment.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 1:
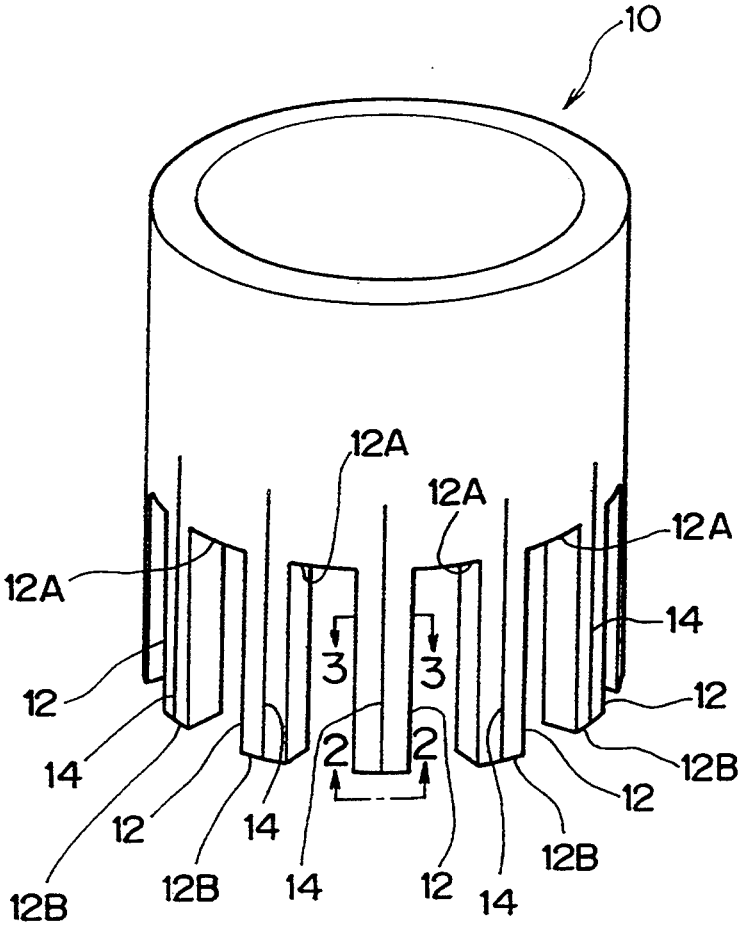
FIG. 1 is a perspective view showing a commutator immediately before soldering material is adhered thereto and to which a soldering material adhering method according to a first embodiment of the present invention is to be applied.

FIG. 1 is a perspective view showing a commutator 10 as a connecting member, immediately before a soldering material is applied thereto and to which a first embodiment of the present invention is applied.

In this case, the commutator 10 is shaped substantially in the form of a cylinder (the commutator having an outside diameter of, for example, 16 mm). The commutator 10 also has around the entire circumference of one end a plurality of claw-shaped connecting portions 12 extending along the axial dimension thereof in parallel with each other and at equal intervals. The ends of these claw-shaped connecting portions 12 are shaped in the form of hooks, and windings (to be explained later) for an armature coil are electrically connected thereto.

Figure 2:
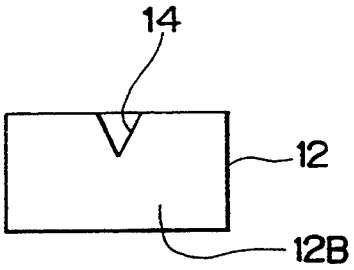
FIG. 2 is a view showing an edge of a claw-shaped connecting bar as seen from the direction indicated by arrows 2, 2 in FIG. 1.
Figure 3:
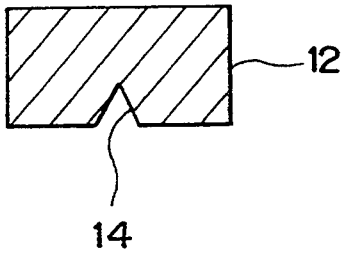
FIG. 3 a cross-sectional view of the claw-shaped connecting bar taken along line 3—3 of FIG. 1.

The claw-shaped connecting portions 12 respectively have straight grooves 14 as concave portions defined in transversely intermediate portions of the outer peripheral surfaces thereof in parallel to each other and to the axial dimension of the commutator. As shown in FIGS. 2 and 3, the grooves 14 have V-shaped cross-sections and dimensions of 0.15 mm in both width and depth in the present embodiment. The grooves 14 have upper edges which extend slightly above base end portions 12A of the claw-shaped connecting portions 12, and lower edges which extend to edges 12B of the claw-shaped connecting portions 12. Thus, the grooves 14 extend across portions where the windings for the armature coil are electrically connected to the claw-shaped connecting portions 12.

Figure 4:
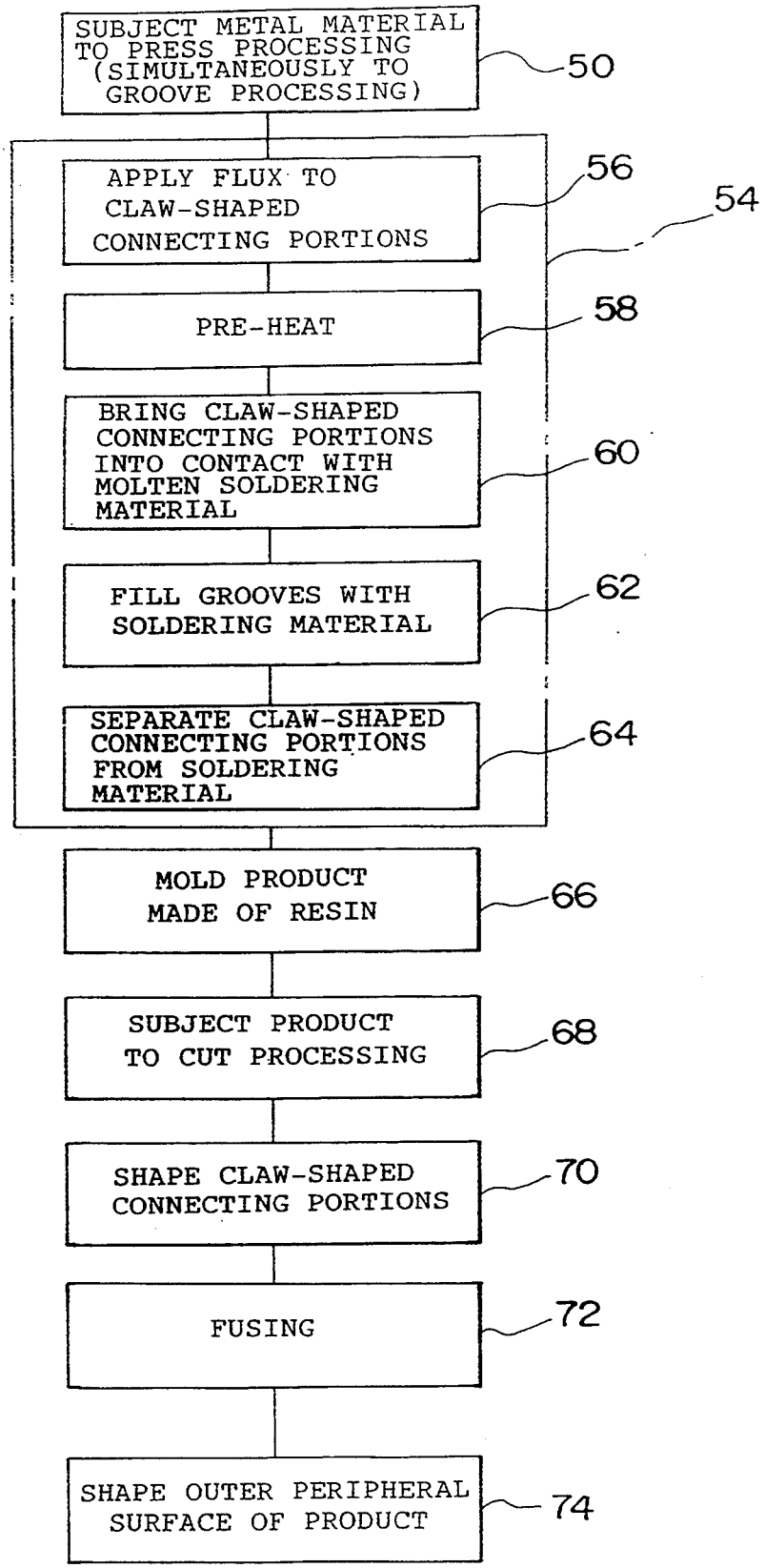
FIG. 4 is a flowchart describing each step of the procedure for manufacturing a commutator.

The procedure for fabricating the commutator 10 will now be described in accordance with the commutator production steps shown in FIG. 4.

Figures 5A, 5B, 5C, 5D, 5E:
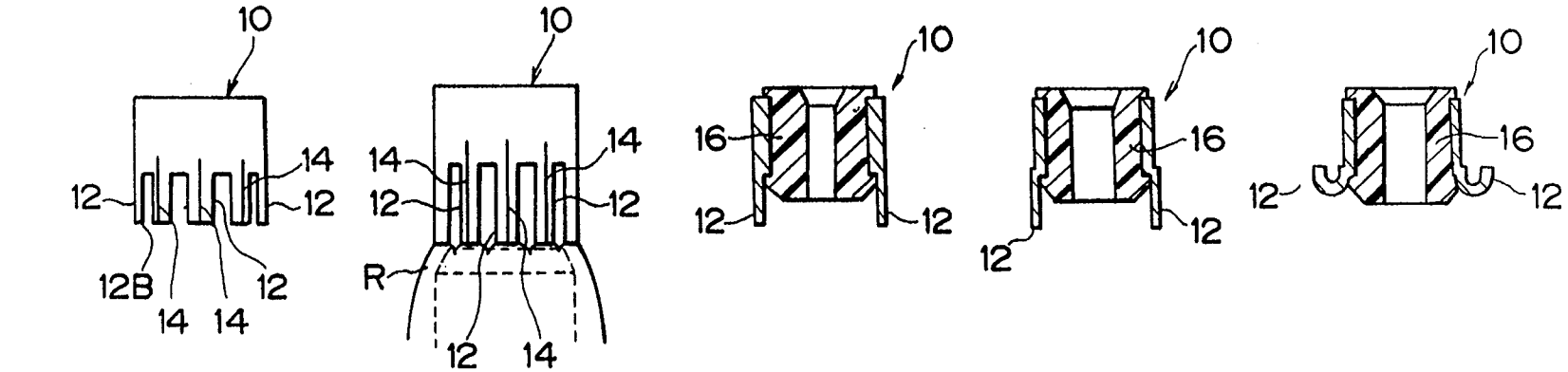
FIGS. 5(A) through 5(E) are schematic views of different commutators corresponding to their respective sequences of manufacturing steps.

In Step 50, a metal material is first molded by pressing or the like so as to produce the basic shape of the commutator 10 including the respective claw-shaped connecting portions 12, and the grooves 14 are defined in the respective claw-shaped connecting portions 12. The grooves 14 may also be defined by cutting or the like in another step. Thus, the commutator 10 can basically be shaped substantially in the form of a cylinder as shown in FIGS. 1 and 5(A).

The thus-formed commutator 10 is then subjected to a soldering material adhering process in Step 54. More specifically, flux is applied to the edges 12B of the respective claw-shaped connecting portions 12 (and their outer peripheral portions) in Step 56, and the commutator 10 is pre-heated in Step 58. As a consequence, the temperature of each of the claw-shaped connecting portions 12 is increased and volatile portions in the flux are removed from the flux by evaporation. In Step 60, the claw-shaped connecting portions 12 are then brought into contact with molten soldering material R (see the state shown in FIG. 5(B)).

Figure 6:
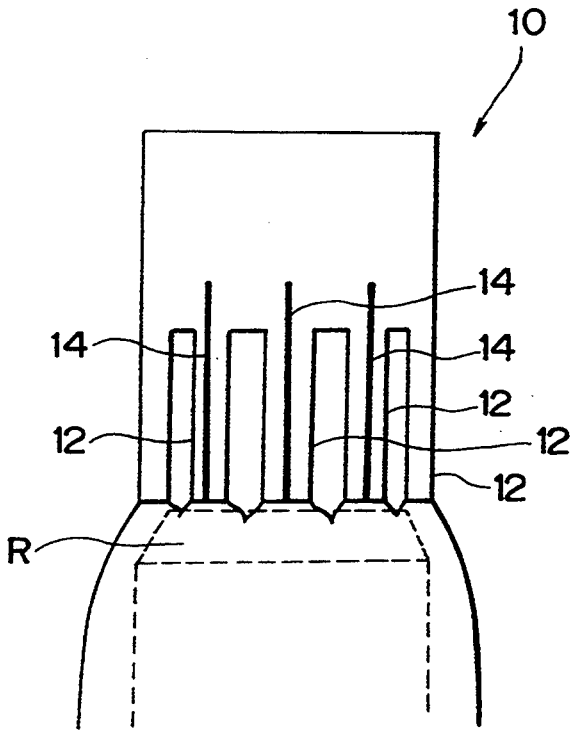
FIG. 6 is a front view of a commutator processed for the adhesion of a soldering material thereto.

When the edges 12B of the claw-shaped connecting portions 12 are brought into contact with the molten soldering material R as shown in detail in FIG. 6, the temperature of each of the claw-shaped connecting portions 12 is increased so as to activate the flux, thereby increasing the surface lubricating action thereof. When the temperature of each of the grooves 14 reaches the melting temperature of the soldering material, the soldering material R is elevated toward the grooves 14 by capillary action. As a consequence, the grooves 14 are filled with the soldering material R in Step 62.

After each of the grooves 14 is charged with the soldering material R, the claw-shaped connecting portions 12 are separated from the molten soldering material R in Step 64. Thereafter, the soldering material R in the grooves is solidified as a result of cooling and hence each of the grooves 14 is reliably charged with solid soldering material R. The process of adhering the soldering material is completed in this way.

After the grooves 14 are filled with the soldering material R, the routine procedure proceeds to Step 66, and the inside of the commutator 10 and the base end portions 12A between the adjacent claw-shaped connecting portions 12 are charged with resin, and a resin insulator is molded integrally with the commutator with the aid of an unillustrated molding die (see the state illustrated in FIG. 5(C)). Then, the inner peripheral wall of the insulator made of the resin 16 and a part of the outer peripheral wall of the commutator 10 are subjected to a cutting process in Step 68, thereby forming a smaller-diameter portion 10A of the commutator (see the state shown in FIG. 5(D)).

Figure 8:
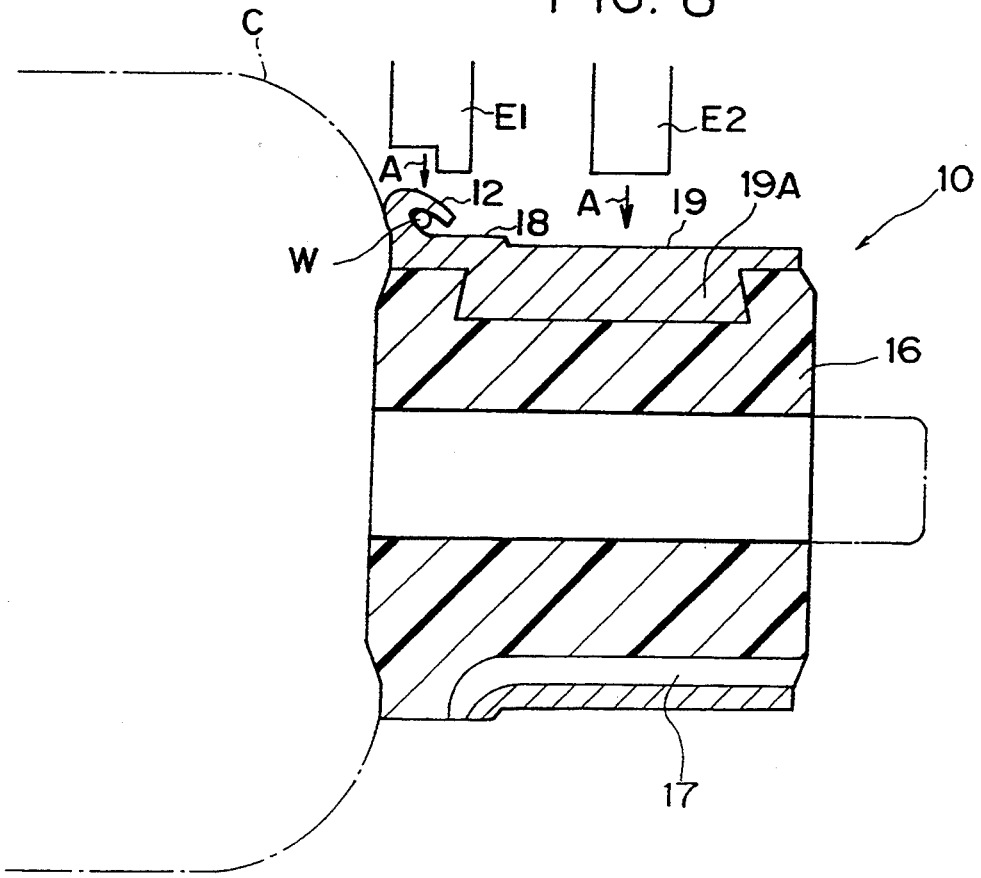
FIG. 8 is a cross-sectional view of the commutator taken along line 8—8 of FIG. 7.

Incidentally, as shown in FIG. 8, it is preferable to have molded in advance a trapezoid-shaped projection 19A projecting from a part of the inner periphery of the commutator 10 so as to improve the connecting strength between the commutator and the insulator made of the resin 16, by means of the projection 19A.

Then, in Step 70, each of the respective claw-shaped connecting portions 12 is subjected to a bending process so as to have a predetermined shape (see the state illustrated in FIG. 5(E)). After the bending processing of each of the claw-shaped connecting portions 12 has been completed, the respective windings for the armature coil are subjected to an electrical fusing process such as resistance welding or the like for connecting them to the respective claw-shaped connecting portions 12, in Step 72. When the windings for an armature coil C are electrically connected to the claw-shaped connecting portions 12 as illustrated in FIG. 8, ends W of the windings are wound and mounted on the claw-shaped connecting portions 12, and the soldering material R previously applied to the grooves 14 is re-melted by heat produced at the time of the resistance welding via electrodes E1 and E2, so that the whole peripheral surface of the connections where respective windings are electrically connected to each of the claw-shaped connecting portions 12 is covered with the soldering material R, thereby enabling the prevention of subsequent thermal expansion or contraction or an increase in the electrical resistance due to oxidation.

The grooves 14 may be charged with a specified amount of the soldering material R. A large amount of soldering material R is not necessary, that is, the grooves 14 need not be filled to the extent that the soldering material R bulges from the grooves 14. The reason for this is that each of the claw-shaped connecting portions 12 is flattened with a force produced by pressing the electrodes E1, E2 in the direction indicated by the arrow A, and the soldering material R is re-melted by current supplied to the electrodes E1, E2, thereby causing the soldering material R to effuse from the grooves 14. The re-melting of the soldering material R ensures the electrical connection between the ends W of the windings for the coil and the claw-shaped connecting portions 12, and thermal expansion and contraction or an increase in electrical resistance due to oxidation are prevented.

Figure 7:
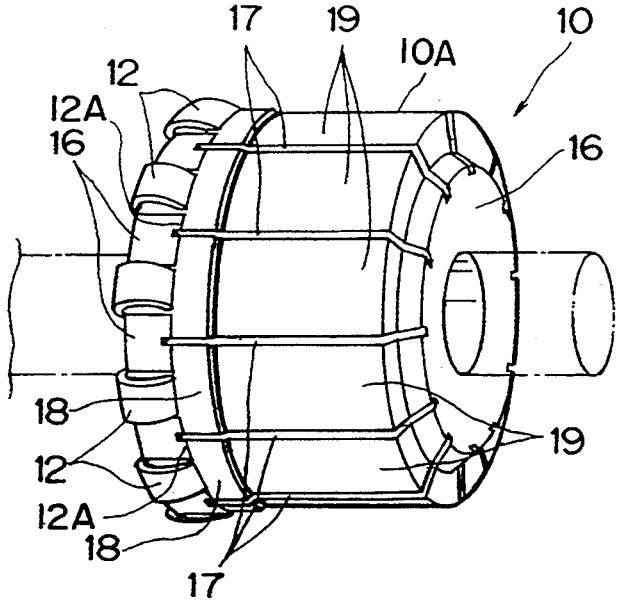
FIG. 7 is a perspective view showing a completed commutator.

As illustrated in FIGS. 7 and 8, slit-shaped cuts 17 are defined in the commutator and the insulator made of resin 16 thereby dividing the commutator and the outer peripheral surface of the insulator in Step 74 into segments so as to insulate respective joined pairs of risers 18 and segments 19 from other joined pairs of risers 18 and segments 19, thereby completing all the steps.

As described above, since only the grooves 14 predefined in the claw-shaped connecting portions 12 are charged with soldering material R, the soldering material R is not applied to any portion other than those portions where respective windings are electrically connected to each of the claw-shaped connecting portions 12, i.e., the soldering material is not applied to any portion to which it is normally unnecessary to apply it. It is therefore unnecessary to apply masking or the like to the portions other than the connecting portions, and the amount of adhesion of the soldering material R to such portions can be reduced to the minimum amount required, thereby making it possible to improve the efficiency of production of the commutator and reduce its manufacturing cost. With this objective, the edges 12B of the claw-shaped connecting portions 12, and the intermediate portions (i.e., portions other than the portions where the windings for the armature coil are electrically connected to the claw-shaped connecting portions 12 by resistance welding) of the grooves 14 corresponding to the transversely intermediate portions of the claw-shaped connecting portions 12, may be shaped in a form having a small cross-sectional area and therefore small volume. As a consequence, the amount of soldering material R adhering to the portions at which soldering material is not required can be further reduced, thereby providing a further advantageous effect.

Since the soldering material R can be adhered by merely bringing the edges 12B of the claw-shaped connecting portions 12 into contact with the molten soldering material R, the. provision of facilities for processing acidic waste-liquids or the like is unnecessary, and the process of adhesion of the soldering material can be carried out by small and simplified equipment. Since only the edges 12B of the claw-shaped connecting portions 12 are in contact with the molten soldering material R upon adhesion of the soldering material R to the portion where each winding is electrically connected to each of the claw-shaped connecting portions 12, the area of the portion of the molten soldering material R which is brought into contact with air can be greatly reduced, so that the oxidation of the soldering material R can be reduced.

Figures 9A, 9B, 9C, 9D, 9E:
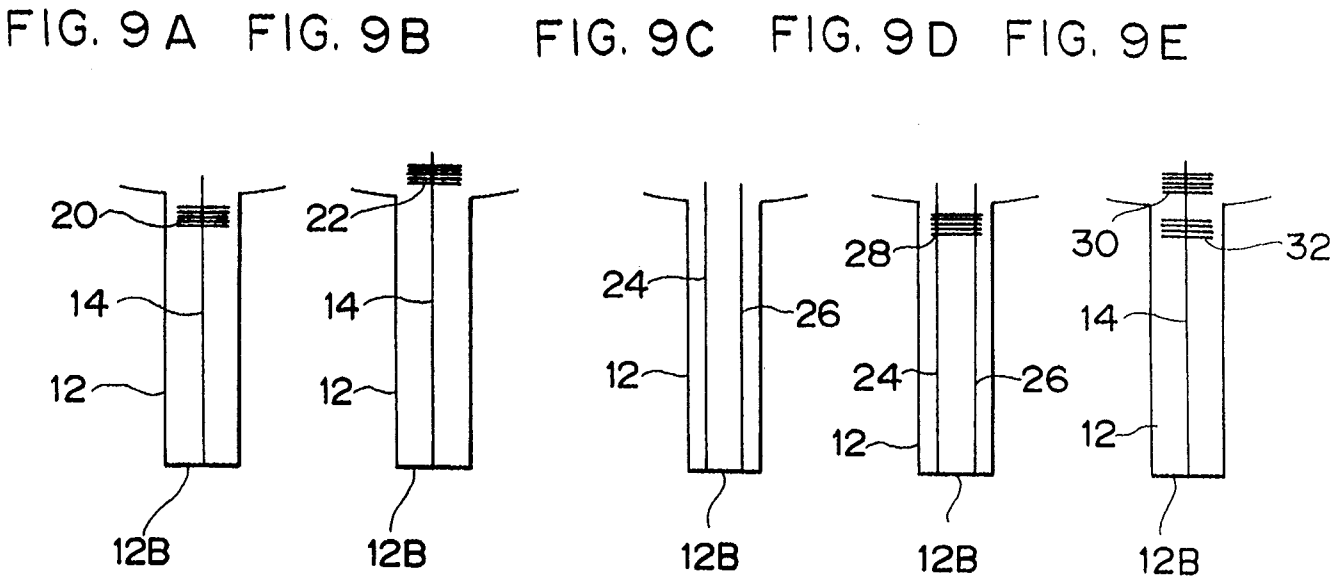
FIG. 9(A) through 9(E) front views showing other examples of grooves defined in different claw-shaped connecting portions.

Incidentally, the grooves 14 comprising the concave portions are defined singly in the claw-shaped connecting portions 12, respectively, in the present embodiment. However, the present invention is not necessarily limited to the present embodiment. Other grooves perpendicular to the grooves 14 may further be defined. As shown in FIG. 9(A) or 9(B) by way of example, transverse grooves 20 or 22 may be defined in association with the portions where the windings are electrically connected to the claw-shaped connecting portions 12. In addition, the grooves defined in the claw-shaped connecting portions 12 respectively are not necessarily limited to the one-on-one formation. Two grooves 24, 26 may be defined in each claw-shaped connecting portion 12 as shown in FIG. 9(C) more than two grooves may be defined therein. As illustrated in FIG. 9(D), transverse grooves 28 perpendicular to the two grooves 24, 26 may be defined as well as the two grooves 24, 26 defined in the claw-shaped connecting portions 12. As shown in FIG. 9(E), transverse grooves 30, 32 may be defined in plural places in association with the portions where the windings are electrically connected to the claw-shaped connecting portions 12. In these cases, the portions where the windings are electrically connected to the claw-shaped connecting portions 12 can be covered more reliably with the soldering material R.

Figure 10:
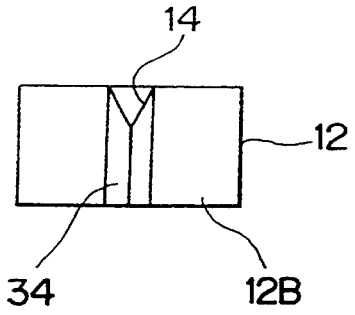
FIG. 10 is a view depicting the reverse side of another groove defined in a claw-shaped connecting bar.

In the present embodiment, the grooves 14 are respectively defined only in the outer peripheral surfaces of the claw-shaped connecting portions 12. However, end grooves 34, which communicate with the grooves 14, may further be defined in the ends 12B of the claw-shaped connecting portions 12, respectively, as illustrated in FIG. 10. When the ends 12B of the claw-shaped connecting portions 12 are dipped into the molten soldering material R so as to charge the grooves 14 with the soldering material R, the penetration of the soldering material R into the grooves 14 via the end grooves 34 is facilitated, and hence the charging of the grooves 14 with the soldering material R can be carried out more reliably.

Figure 11A:
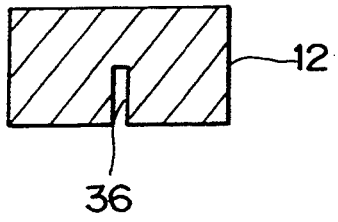
FIGS. 11(A) and 11(B) are cross-sectional views showing other examples of grooves defined in claw-shaped connecting portions, the views each corresponding to the view shown in FIG. 3.
Figure 11B:
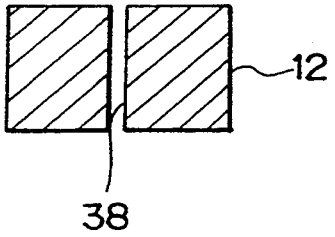

Further, the grooves 14 have V-shaped cross sections and are defined in the outer peripheral surfaces of the claw-shaped connecting portions 12 in the present embodiment. However, the present invention is not necessarily limited to the present embodiment. As illustrated in FIG. 11(A), each of the grooves 36 may be defined in the form of a slit having a rectangular cross-section. As also shown in FIG. 11(B), "through grooves" 38 extending right through the claw-shaped connecting portions 12 may be defined. Even in these cases, the soldering material R can be introduced only into the grooves 36 or the through grooves 38. The amount of soldering material R adhering to the commutator can thus be reduced to the minimum amount required, thereby making it possible to reduce manufacturing cost.

Other embodiments of the present invention will now be described. Incidentally, elements of structure basically identical to those in the first embodiment will hereinafter be identified by like reference numerals and their description will therefore be omitted.

Figure 12:
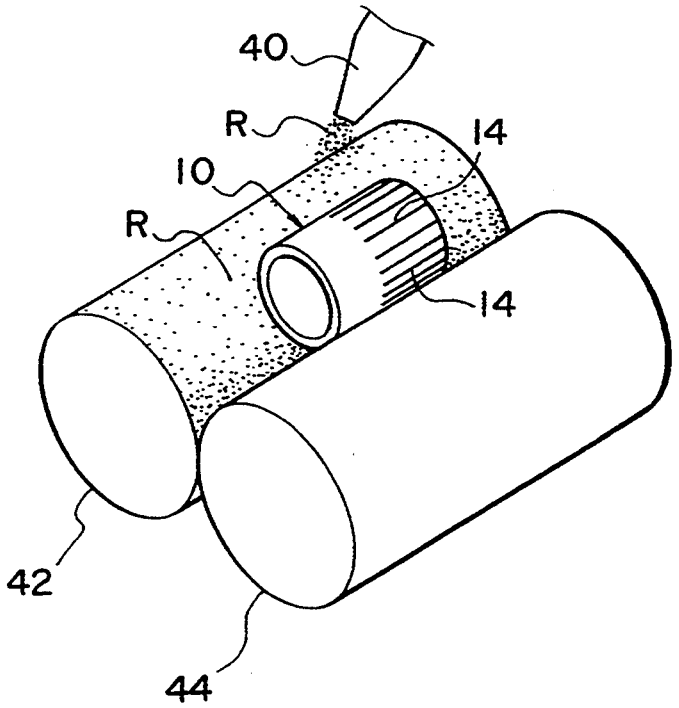
FIG. 12 is a perspective view schematically showing the structure of a soldering material adhering method according to a second embodiment of the present invention.

FIG. 12 is a perspective view schematically showing the structure of a method according to a second embodiment of the present invention for adhering a soldering material to a commutator.

A metal material is basically shaped in the form of a cylinder, and a commutator 10 having a plurality of grooves 14 as concave portions defined therein is placed between a pair of spreading rollers 42, 44. Then, a paste-like soldering material R containing flux is applied to the surfaces of the spreading rollers 42, 44 by a nozzle 40. Under this condition, the spreading rollers 42, 44 are rotated so as to charge the grooves 14 defined in the commutator 10 with the soldering material R (this process being called roller printing). Then, the residual soldering material R applied to portions of the surface of the commutator 10 other than the grooves 14 is removed from these portions by using a brush or the like, and thereafter the whole of the commutator 10 is heated. As a consequence, the soldering material is melted so as to charge the grooves 14 therewith. Thereafter, the soldering material R is solidified by cooling, so that the grooves 14 are reliably charged therewith. Thus, the process of adhesion of the soldering material R to the commutator 10 is finished.

Even in the present embodiment, similarly to the previously-described embodiment, the soldering material R is introduced only into the pre-defined grooves 14. Therefore, the soldering material R does not adhere to the portions to which it is normally unnecessary to apply it. It is therefore unnecessary to apply masking or the like to such portions, and therefore the amount of soldering material R adhering to the commutator can be reduced to the minimum amount required, thereby making it possible to improve the efficiency in production of the commutator and reduce its manufacturing cost.

Figure 13:
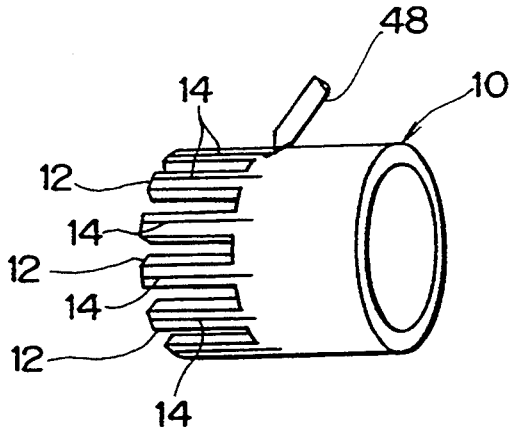
FIG. 13 is a perspective view schematically showing the structure of a soldering material adhering method according to a third embodiment of the present invention.
Figure 14:
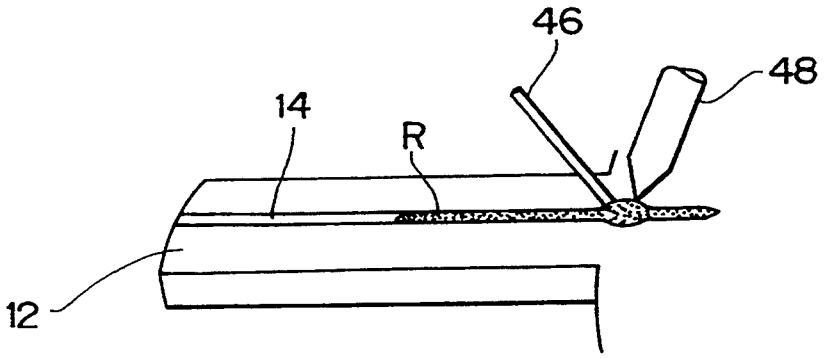
FIG. 14 is a partial enlarged view of the structure shown in FIG. 13.

FIG. 13 is a perspective view schematically showing the structure of a method according to a third embodiment of the present invention for adhering a soldering material to a commutator. FIG. 14 is a partial enlarged view of the structure shown in FIG. 13.

In the present embodiment, the insides of grooves 14 as concave portions pre-defined in claw-shaped connecting portions 12 of a commutator 10 are soldered using a wire solder 46 or a soldering iron 48 for example, and the molten solder spreads spontaneously so as to charge the grooves 14 therewith. In this case, as well, since only the pre-defined grooves 14 are charged with the soldering material R, the amount of soldering material R adhering to the commutator can be reduced to the minimum amount required, and hence the manufacturing cost of the commutator can be reduced.

Incidentally, the above-described embodiments have shown and described a method of adhering a soldering material to a base material, i.e., a commutator as a connecting member. However, the present invention is not necessarily limited to such embodiments. As long as a connecting member is provided to which a connecting line is to be connected by thermal welding, then the invention can be applied to other items as well such as a printed circuit board. In such applications, the soldering material is not adhered to portions to which it is unnecessary to adhere it. Thus, the amount of soldering material adhering to those portions can be reduced to the minimum amount required, so that the item can be manufactured at a low cost.

Having now fully described the invention, it will be apparent to those skilled in the art that many changes and modifications can be made without departing from the spirit or scope of the invention as set forth herein.

What is claimed is:

1. A method of pre-applying soldering material on a motor commutator and thermal welding of connectors thereto, the motor commutator comprising a cylindrical member having one end formed with a plurality of connecting portions, and each of said connecting portions being formed with a concave groove commencing at about a distal end of the connecting portion and extending away from the distal end to at least a predetermined area where a conductive wire is to be electrically connected, said method of pre-applying soldering material comprising the steps of:

heating said commutator;

applying the distal ends of the connecting portions but not the predetermined area to molten soldering material such that said molten soldering material is drawn into the concave grooves of said connecting portions by means of capillary action to the predetermined area;

removing the distal ends from the molten soldering material and allowing the molten soldering material which was drawn into the concave grooves to solidify; and thermally welding at least one connecting wire to the commutator such that the heat produced by the weld melts the soldering material which was drawn into the concave grooves, thus effecting the electrical connection between the commutator and conductive wires.

2. A method according to claim 1, wherein said step (b) is carried out after flux is applied to said commutator base material.

3. A method according to claim 1, wherein said concave groove is at least one narrow groove defined in said commutator along the surface thereof, and said soldering material is introduced into said at least one narrow groove from one end thereof by means of capillary action.

4. A method according to claim 1, wherein said soldering material introduced in said step (b) contains flux and is in a non-molten form such as a paste, and said soldering material is introduced into said concave groove of said commutator, followed by heating and melting of said soldering material containing spread into said concave groove, after which said soldering material is solidified in said concave groove.

5. A method of adhering a soldering material to each of a plurality of connecting portions and of electrically connecting the portions to the ends of respective windings for an electric motor, said method being suitable for use in a commutator for an electric motor, said method comprising the steps of:

providing narrow grooves in said plurality of connecting portions to which said respective motor windings are to be electrically connected, said narrow grooves commencing at about the distal ends of said connecting portions and extending away from the distal ends to at least a predetermined area where the windings are to be connected; and bringing the ends of said narrow grooves at said distal ends of said connecting portions but not the predetermined area into contact with soldering material in a molten state so as to charge said soldering material through said narrow grooves by means of capillary action to at least the predetermined area, removing the ends of said narrow grooves from the soldering material which is in a molten state and allowing the soldering material which was drawn into the narrow grooves to solidify, and welding the windings to the commutator such that the heat produced by the weld melts the soldering material which was drawn into the narrow grooves, thus effecting the electrical connection between the commutator and the windings.

6. A method according to claim 5, wherein said connecting portions are shaped in the form of a plurality of claw-shaped portions extending from a cylindrical body along the axial dimension thereof, and said narrow grooves are defined in the respective outer peripheries of said claw-shaped portions.

7. A method according to claim 6, wherein said narrow grooves extend to the distal end portions of said claw-shaped portions, and said distal end portions of said narrow grooves are brought into contact with said soldering material in a molten state.

8. A method according to claim 5, wherein the bottom of each of said narrow grooves has a width narrower than that of the entrance thereof.

9. A method according to claim 5, wherein a plurality of additional narrow grooves each intersecting said narrow grooves are further defined in addition to said narrow grooves.

10. A method according to claim 6, wherein said narrow grooves each penetrate from the outer side through to the inner side of one of said claw-shaped portions.

11. A method according to claim 5, wherein said narrow grooves are defined in such a manner that the width thereof, as measured at any depth from the entrance thereof to the bottom thereof, is constant.

12. A method according to claim 1, wherein said commutator of said motor has a plurality of connecting portions, and respective ends of the connecting portions are simultaneously brought into contact with said molten soldering material, and said molten soldering material is simultaneously introduced into and filled in said connecting portions through said concave groove of said commutator.

13. A method of preparing a commutator of a motor with a soldering material and thermal welding of a conductive wire thereto, said commutator being in the form of an upright cylinder and having a bottom end with at least one connecting portion extending axially along the commutator, and wherein one or more grooves are defined in an outer peripheral surface of said connecting portion commencing at about a bottom edge of the connecting portion, extending away from the bottom edge to at least a predetermined area where a conductive wire is to be connected, and running axially along said commutator, said method comprising the following steps:

(a) applying flux to the bottom edge of said connecting portions;

(b) heating said connecting portions to thereby remove a volatile portion of flux;

(c) applying said bottom edge but not the predetermined area to molten soldering material to thereby introduce molten soldering material into said groove by capillary action to at least the predetermined area;

(d) removing the bottom edge from the molten soldering material and allowing the molten soldering material which was introduced into said groove to solidify; and (e) thermally welding at least one connecting wire to the commutator such that the heat produced by the weld melts the soldering material which was introduced into said groove, thus effecting the electrical connection between the commutator and conductive wire.

* * * * *